US009138751B2

(12) United States Patent
Gravett et al.

(10) Patent No.: US 9,138,751 B2
(45) Date of Patent: Sep. 22, 2015

(54) METHOD FOR SOLID WASTE SEPARATION AND PROCESSING

(75) Inventors: Martin Richard Gravett, Salisbury (AU); Janusz Krzysztof Fulara, Kallaroo (AU)

(73) Assignee: ANAECO LIMITED, Bentley (AU)

( * ) Notice: Subject to any disclaimer, the term of this patent is extended or adjusted under 35 U.S.C. 154(b) by 0 days.

(21) Appl. No.: 14/342,062

(22) PCT Filed: Sep. 6, 2012

(86) PCT No.: PCT/AU2012/001061
§ 371 (c)(1), (2), (4) Date: May 15, 2014

(87) PCT Pub. No.: WO2013/033776
PCT Pub. Date: Mar. 14, 2013

(65) Prior Publication Data

US 2014/0246358 A1 Sep. 4, 2014

(30) Foreign Application Priority Data

Sep. 6, 2011 (AU) ..... 2011903618

(51) Int. Cl.

| | |
|---|---|
| ***B07B 9/00*** | (2006.01) |
| ***B03B 7/00*** | (2006.01) |
| ***B03C 3/017*** | (2006.01) |
| ***B03C 3/08*** | (2006.01) |
| ***B03C 3/16*** | (2006.01) |
| ***B03B 9/06*** | (2006.01) |

(52) U.S. Cl.
CPC ... *B03B 7/00* (2013.01); *B03B 9/06* (2013.01); *B03C 3/017* (2013.01); *B03C 3/08* (2013.01); *B03C 3/16* (2013.01)

(58) Field of Classification Search
CPC ..... B07B 9/00; B07B 9/06
USPC ..... 209/12.1, 38, 930, 17
See application file for complete search history.

(56) References Cited

U.S. PATENT DOCUMENTS

| | | | | |
|---|---|---|---|---|
| 4,044,956 | A * | 8/1977 | Benedetto et al. | 241/20 |
| 4,077,847 | A * | 3/1978 | Choi et al. | 201/21 |
| 4,116,822 | A * | 9/1978 | Webb | 209/11 |
| 4,778,116 | A * | 10/1988 | Mayberry | 241/79.1 |

(Continued)

FOREIGN PATENT DOCUMENTS

| | | |
|---|---|---|
| DE | 1224672 B | 9/1966 |
| DE | 19617734 C1 | 10/1997 |

(Continued)

OTHER PUBLICATIONS

Supplementary European Search Report issued in European Application No. 12830077.9 on Apr. 8, 2015, 7 pages.

*Primary Examiner* — Terrell Matthews
(74) *Attorney, Agent, or Firm* — Rothwell, Figg, Ernst & Manbeck, P.C.

(57) ABSTRACT

A method for solid waste separation and processing (10) comprising the method steps of: (a) Passing a municipal solid waste (12) to a first size based separation step (14) producing at least a fine organic fraction (16) and a coarse fraction (18); (b) Passing the fine organic fraction (16) to a digestion process (20) by way of a glass and grit separation step (24); and (c) Recirculating the coarse fraction (18) of step (a) through the first size based separation step (14) at least once.

22 Claims, 7 Drawing Sheets

(56) References Cited

U.S. PATENT DOCUMENTS 5,322,170 A * 6/1994 Hadden ..... 209/314
2008/0020456 A1 1/2008 Choate et al.

FOREIGN PATENT DOCUMENTS

DE 10028976 A1 12/2001
GB 2208645 A 4/1989

* cited by examiner

METHOD FOR SOLID WASTE SEPARATION AND PROCESSING

CROSS REFERENCE TO RELATED APPLICATIONS

This application is a 35 U.S.C. §371 National Phase Entry Application from PCT/AU2012/001061, filed Sep. 6, 2012, and designating the United States, which claims priority under 35 U.S.C. §119 to Australian Provisional Patent Application No. 2011903618 filed Sep. 6, 2011, which is incorporated herein in its entirety.

FIELD OF THE INVENTION

The present invention relates to a method for solid waste separation and processing. More particularly, the method of the present invention is intended for use in the processing of mixed municipal solid waste.

BACKGROUND ART

The treatment of mixed municipal solid waste ("MSW") presently most typically comprises passing that waste to some form of separation process by which organic materials therein are first separated, as much as possible, from inorganic materials. This initial separation step is invariably a size based separation, with organic material typically being smaller or softer than much of the inorganic material. The organic materials are subsequently directed, at least in part, to a rotting process, whilst the inorganic material is sorted into recyclables and non-recyclables, the latter being passed to landfill. The product of the rotting process is ideally a compost material and a biogas.

The efficiency of such processes are highly dependent upon the effectiveness of the manner in which the various separation steps are conducted. Further, the usefulness of the final products of such processes are dependent in large part upon their purity. For example, it is highly preferable if each of glass and grit, film plastics material and both ferrous and non-ferrous materials are removed from the organic material. However, there is invariably a compromise struck between the time taken to achieve a completely efficient result and the cost associated with such.

The composting processes utilised in traditional processes often produce odours which must be combated with expensive and complicated odour treatment arrangements if the treatment facility is anywhere near urban development. Alternatively, the treatment facility must be placed in very remote locations, which is not always possible or desirable.

Regarding the rotting process employed, it is known that solid organic waste material may be treated under either anaerobic or aerobic conditions to produce a bioactive, stable end product that, for example, may be used as compost for gardens or agriculture. This process is achieved through the action of, respectively, anaerobic or aerobic microorganisms that are able to metabolise the waste material to produce the bioactive, stable end product.

It is also known that the aerobic decomposition of solid organic waste material takes place in the presence of oxygen. The temperature of the waste material rises as some of the energy produced during aerobic decomposition is released as heat, often reaching temperatures of approximately 75° C. under ambient conditions. The solid end product is often rich in nitrates which are a readily bio-available source of nitrogen for plants, making the end product particularly suitable as a fertiliser.

It is further known that the anaerobic digestion of solid organic waste material takes place in the absence of oxygen. Anaerobic microbial metabolism is understood to be optimised when the organic material is heated to temperatures at which mesophilic or thermophilic bacteria are operative. The process of anaerobic microbial metabolism results in the production of biogas, in turn predominantly methane and carbon dioxide. The solid product of the process is often rich in ammonium salts. Such ammonium salts are not readily bio-available and are, consequently, generally treated under conditions in which aerobic decomposition will occur. In this manner the material is used to produce a product that is bio-available.

Typically, systems for the biodegradation of organic waste material are directed to either aerobic or anaerobic processes. However, there are a small number of systems that have sought to combine both anaerobic and aerobic biodegradation processes. The processes of German Patent 4440750 and International Patent Application PCT/DE1994/000440 (WO 1994/024071) each describe the combination of an anaerobic fermentation unit and an aerobic composting unit. Importantly, these systems describe discrete and separate vessels for the aerobic and anaerobic biodegradation processes.

International Patent Application PCT/AU00/00865 (WO 01/05729) describes an improved process and apparatus in which many of the inefficiencies of the previous processes and apparatus are overcome. The improved process and apparatus are characterised at a fundamental level by the sequential treatment of organic waste material in a single vessel, through an initial aerobic step to raise the temperature of the organic waste material, an anaerobic digestion step and a subsequent aerobic treatment step. During the anaerobic digestion step a process water or inoculum containing micro organisms is introduced to the vessel to create conditions suitable for efficient anaerobic digestion of the contents and the production of biogas. The introduced inoculum also aids in heat and mass transfer as well as providing buffer capacity to protect against acidification. Subsequently, air is introduced to the residues in the vessel to create conditions for aerobic degradation. It is further described that the water introduced during anaerobic digestion may be sourced from an interconnected vessel that has undergone anaerobic digestion.

In US Publication 20050199028 A1 there is described a method and apparatus for treating and recycling mixed municipal solid waste that is intended to minimise the quantity of waste passing to landfill. This involves biological treatment as a first step prior to subsequent separation steps to remove inorganic materials and recover recyclables. A further aerobic microbial treatment is provided before additional screening to remove inert compounds. A final washing step is used to remove salts from the composted organics. No provision is made for the removal of glass and grit in this method. Further, the first separator employed, in the form of a rotating drum, performs a limited size separation, thereby restricting the efficiency of the remainder of the method.

US Publication 20110008865 A1 discloses &method and apparatus for treatment of municipal solid waste in an effort to separate recyclables and to transform solid waste into energy and clean fuel. An initial autoclaving step is integral to the method and is aimed at breaking down fiber to fiber bonds of cellulosic material. A single trommel is used for separation and produces a homogenous organic fraction that is mixed with water from sludge dewatering. The organic stream undergoes fermentation and thermophilic anaerobic digestion. The methane produced is used to generate heat and electrical energy for plant operation. A thickened dewatered sludge is produced by the digesters that is intended as a feedstock for pyrolysis. The oversize from the trommel separation step is passed to steps in which metals, aluminium, glass and plastics are removed. The separation steps employed are coarse and relatively inefficient, including the fact that it is only the oversize from the trommel that is subjected to a number of the separation steps. No provision is made for the capture of organics that may have passed through the single trommel. Further, no provision is made for the separation of glass and grit. The method for solid waste separation of the present invention has as one object thereof to overcome substantially the abovementioned problems of the prior art, or to provide a useful alternative thereto.

The preceding discussion of the background art is intended to facilitate an understanding of the present invention only. The discussion is not an acknowledgement or admission that any of the material referred to is or was part of the common general knowledge as at the priority date of the application.

Throughout the specification and claims, unless the context requires otherwise, the word "comprise" or variations such as "comprises" or "comprising", will be understood to imply the inclusion of a stated integer or group of integers but not the exclusion of any other integer or group of integers.

DISCLOSURE OF THE INVENTION

In accordance with the present invention there is provided a method for solid waste separation and processing comprising the method steps of:)

a) Passing a municipal solid waste to a first size based separation step producing at least a fine organic fraction and a coarse fraction;
b) Passing the fine organic fraction to a digestion process by way of a glass and grit separation step; and
c) Recirculating the coarse fraction of step (a) through the first size based separation step at least once.

Preferably, the fine organic fraction is passed to a metals separation step in which ferrous metals are substantially removed. The metals separation step may be provided in a series of independent steps.

The glass and grit separation step preferably removes a significant proportion of any glass and grit present in the fine organic fraction. Still preferably, the glass and grit separation step is a wet separation step. Still further preferably, the glass and grit separation step is a two-stage wet separation step.

Preferably, prior to the digestion process the fine organic fraction is passed to a separation step in which film plastics are substantially removed.

The first separation step of step (a) preferably comprises passing the municipal solid waste to a trommel, from which the fine organic fraction and coarse fraction are produced. Still preferably, a rejects fraction is also produced by the first separation step of step (a), comprising those materials that pass completely through to the end of the trommel.

Preferably, the first separation step of step (a) homogenises the municipal solid waste passed thereto. The homogenisation is preferably achieved in part through the introduction of water. Further, the homogenisation preferably captures paper and cardboard into the fine organic fraction. Preferably, water sprays are provided in a first portion of the trommel.

Preferably, the coarse fraction produced in step (a) comprises product having a size between about 40 mm and 250 mm.

Still preferably, the coarse fraction produced in step (a) comprises product having a size between about 60 mm and 250 mm.

Preferably, the rejects fraction produced in the first separation step of step (a) has a size of greater than about 250 mm.

Preferably, the digestion process produces an intermediate compost product. The intermediate compost product is preferably passed to a separation step in which residual film plastics are separated from the compost product, and an oversized fraction removed, thereby producing a final compost product.

Still preferably, the coarse fraction is passed to a metals separation step in which ferrous and non-ferrous metals are substantially removed. The metals separation step may be provided in a series of independent steps.

In one form of the present invention the metals separation step comprises passing the coarse fraction to at least a single magnetic separator and an eddy current separator.

Preferably, after the metals separation step the coarse fraction is passed to a sorting step by which plastics materials are separated. This sorting step may be carried out by way of either manual means or mechanical means.

BRIEF DESCRIPTION OF THE DRAWINGS

The method for solid, waste separation and processing of the present invention will now be described, by way of example only, with reference to one embodiment thereof and the following drawings, in which.

BEST MODE(S) FOR CARRYING OUT THE INVENTION

Figure 1:
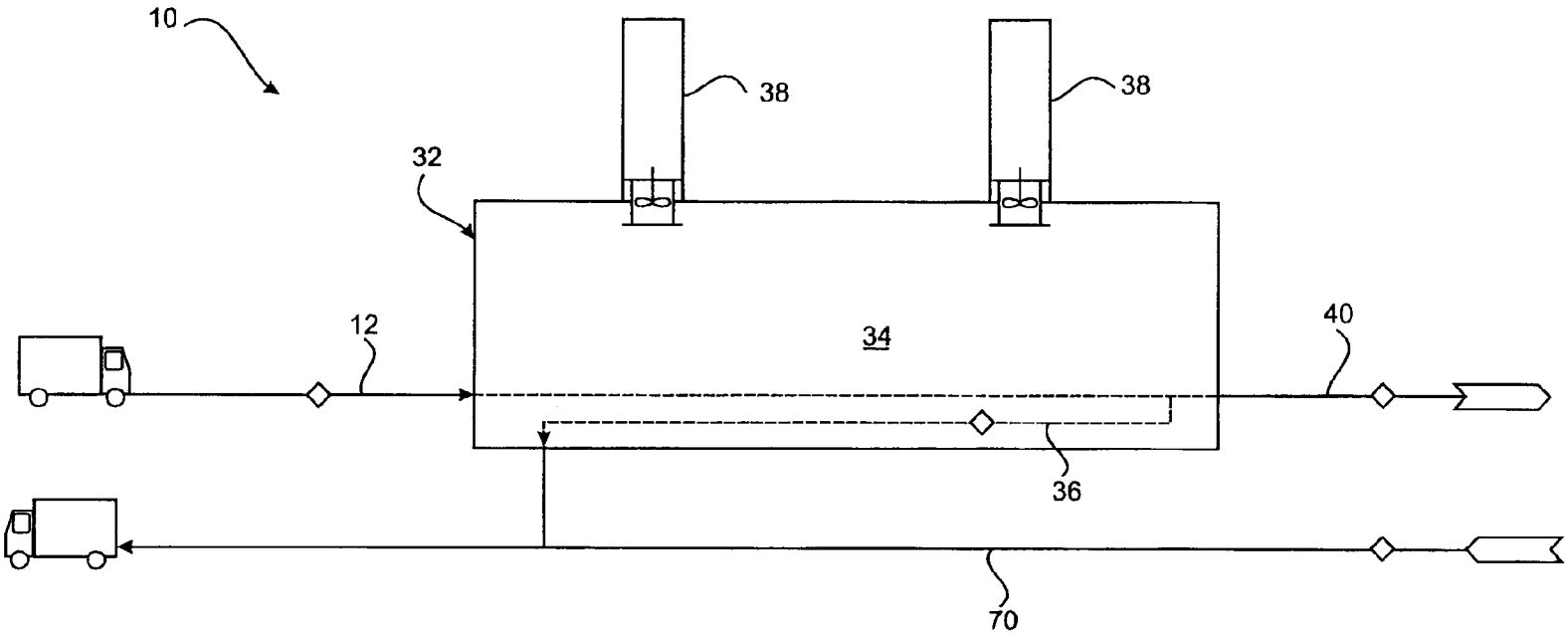
FIG. 1 is a diagrammatic representation of a waste transfer station tipping floor such as may be used as a part of the method of the present invention.

In FIGS. 1 to 7 there is shown a method for solid waste separation and processing 10 in which municipal solid waste ("MSW") 12 is treated. The method 10 comprises a first size based separation step 14 that produces both a fine organic fraction 16 and a coarse fraction 18. The fine organic fraction 16 is made up of material that is less than about 40 mm. The fine organic fraction 16 is ultimately passed to a digestion process 20. The first size separation step 14 also produces a rejects fraction 22.

The coarse fraction 18 may be recirculated to the first size based separation step 14 to improve separation efficiency, if desired.

The fine organic fraction 16 is passed through a glass and grit separation step 24 at a point prior to the digestion process 20, as will be discussed hereinafter. The glass and grit separation step 24 removes a significant proportion of any glass and grit present in the fine organic fraction 16. The glass and grit separation step 24 is a two-stage wet separation step.

Figure 6:
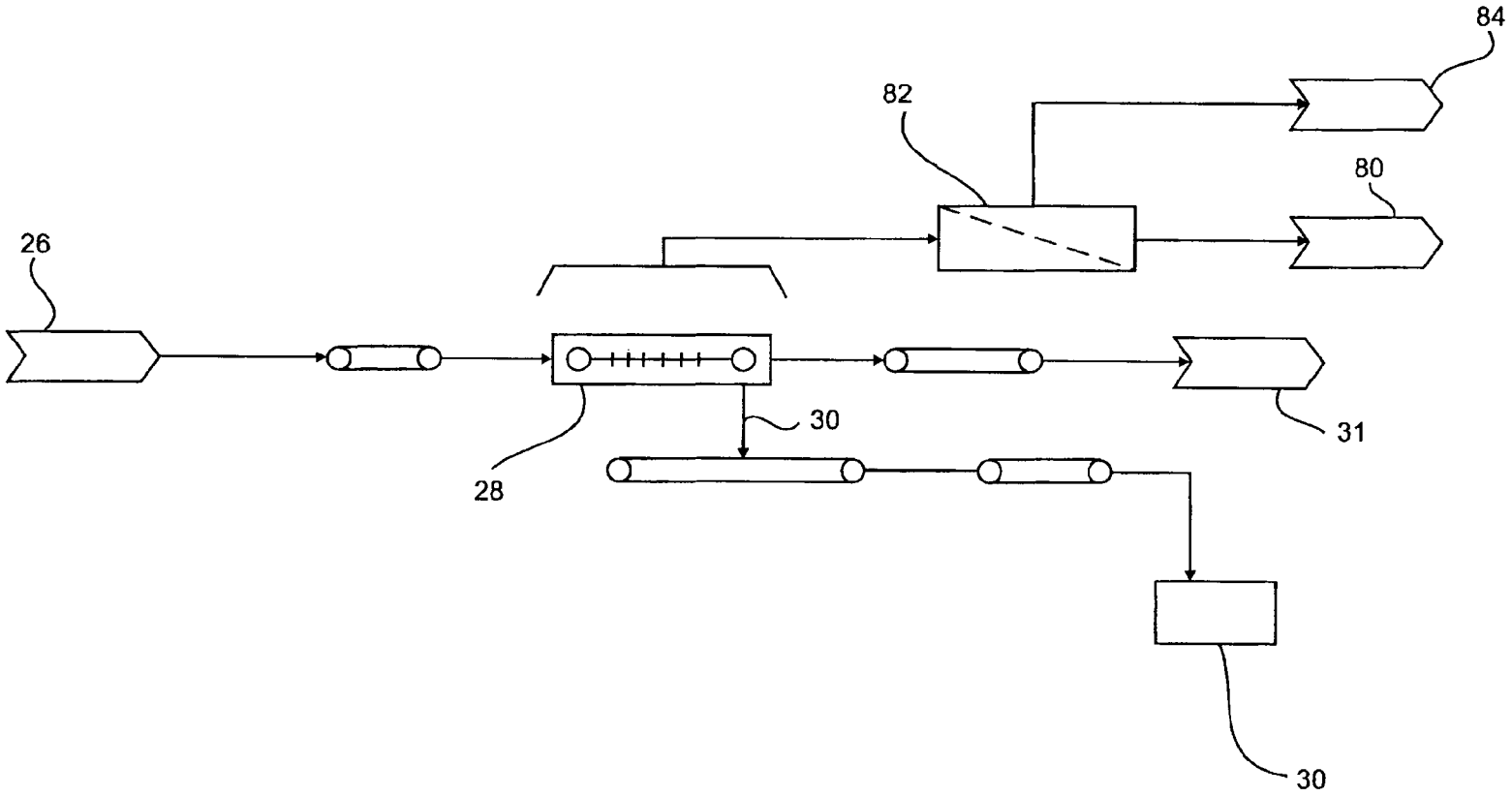
FIG. 6 is a diagrammatic representation of an intermediate compost product being passed to a separation step in which odourous air and film plastics are separated to provide a rejects stream, separated film plastics and odourous air, and a final compost product.
Figure 7:
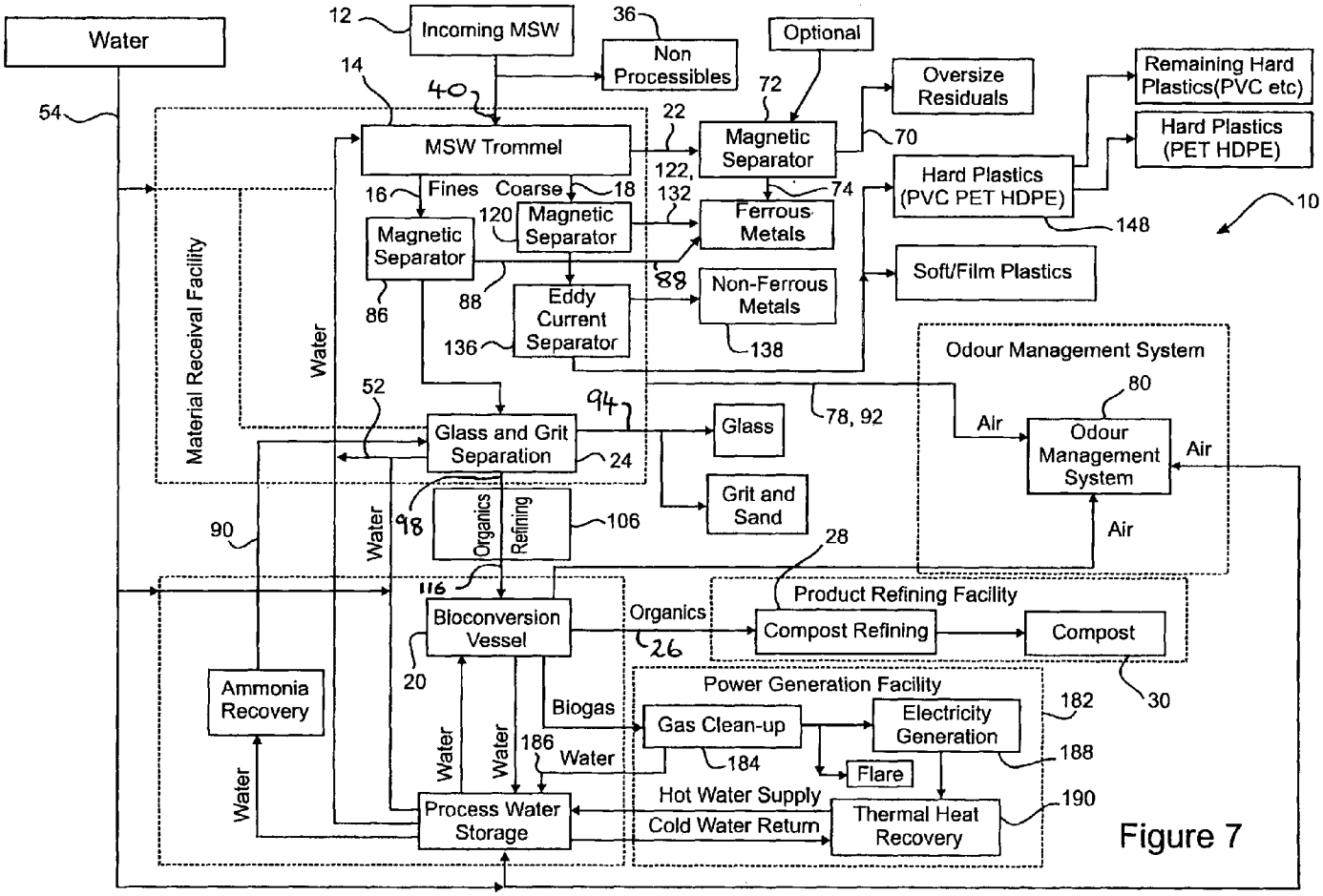
FIG. 7 is a block diagram of the method for solid waste separation and processing of the present invention.

The digestion process 20 produces an intermediate compost product 26. The intermediate compost product 26 is passed to a separation step 28, for example utilising a star screen, in which remaining film plastics are separated from the intermediate compost product 26 thereby producing a final compost product 30, as best seen in FIG. 6. An oversize rejects stream 31 is passed either to rejects or is returned to the first size based separation step 14.

With specific reference to FIG. 1 there is shown the MSW 12 being introduced to a transfer station 32 having a tipping floor 34. The MSW 12 is off loaded from whatever manner of transport has been used to bring the MSW 12 to the transfer station 32 onto the tipping floor 34. Certain non-processible items 36 are able to be identified at this point by operators (not shown) and put aside for combination with a rejects stream to be described hereinafter. The waste transfer station 32 is provided with extraction fans 38 as a method of managing odours encountered at this point of the process 10. The extraction fans 38 may be vented directly to the atmosphere or may be directed to the odour management system to control odour should this be considered necessary.

Figure 2:
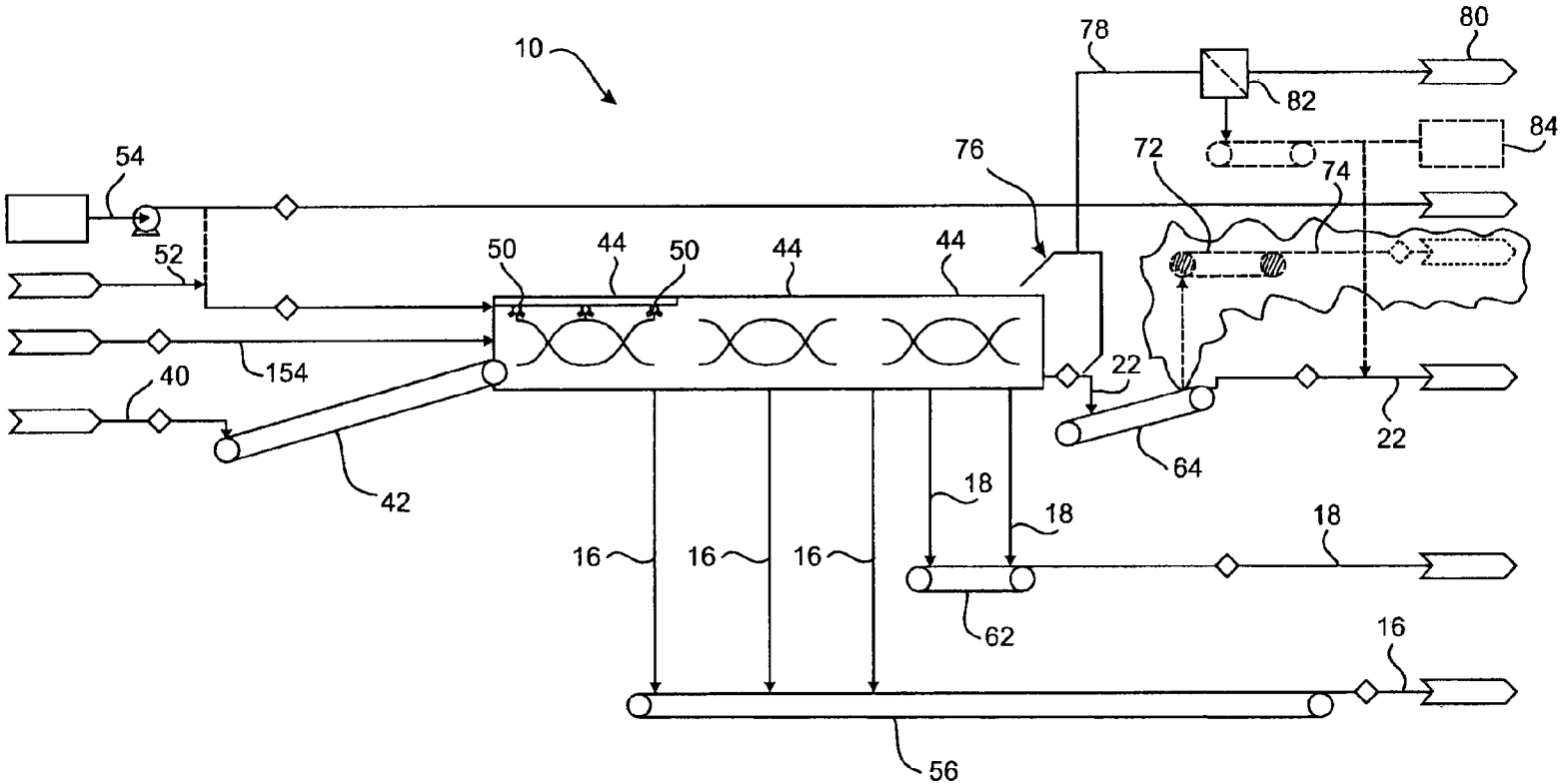
FIG. 2 is a diagrammatic representation of a first size based separation step of the method of the present invention.

The removal of the non-processible items 36 from the MSW 12 provides a MSW stream 40 that is introduced to a conveyor 42, as shown in FIG. 2.

With further reference to FIG. 2, the conveyor 42 feeds the MSW stream 40 to the first size based separation step 14. The first size based separation step 14 comprises a trommel 44 arranged to rotate about its longitudinal axis. The trommel 44 has provided therein a series of screens, each coarser than the one previous. A first portion of the trommel 44 is equipped with sprays 50 through which process water, for example water 52 from the glass and grit separation step 24, and potentially bore make-up water 54, is introduced to the MSW 40 for the purposes of homogenisation of that waste, and improving capture of paper and cardboard into the fine organic fraction 16.

The fine organic fraction 16 is comprised of that material of a size less than about 40 mm which is predominantly the product of the trommel 44. The fine organic fraction 16 passes to a series of conveyors 56, 58 and 60 via the ferrous metals separation step (to be described hereinafter) before passing to the glass and grit separation step 24.

The coarse fraction 18 is predominantly the coarser product of the trommel 44 and is sized between about 40 mm and 250 mm, for example 60 mm and 250 mm. The coarse fraction 18 passes to a conveyor 62 from which it is subjected to a series of process steps to be described hereinafter.

Figure 5:
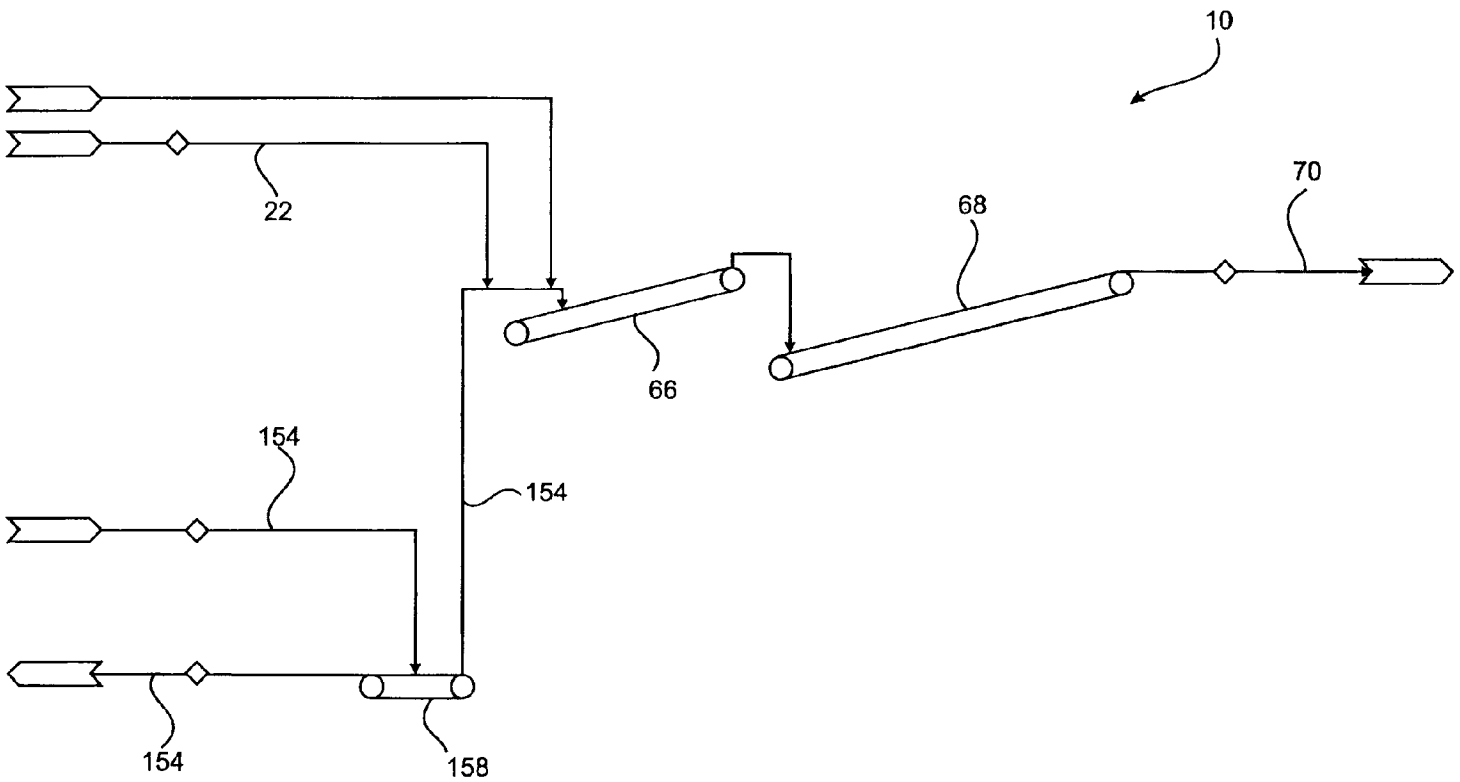
FIG. 5 is a diagrammatic representation of a series of conveyors arranged to receive reject and oversized fractions from other process steps and the transfer of same to waste transfer station collection silos for transport to landfill, and showing the potential reversal of the conveyor for coarse fraction transfer whereby that coarse fraction is recirculated to the first size based separation step.

The rejects fraction 22 is that fraction that passes through to the end of the trommel 44 without passing through the screens provided therein, being larger than about 250 mm. The rejects fraction 22 passes to a series of conveyors 64, 66 and 68 by which it is passed ultimately as a combined rejects stream 70 that may be in turn passed to landfill, as shown in FIGS. 5 and 1. The rejects fraction 22 may be passed to a magnetic separation step 72, shown in FIG. 2, producing an oversize ferrous stream 74.

An air extraction arrangement 76 is provided about the trommel 44 and is directed to the withdrawal of odourous air 78 to be passed to an odour management system 80. The odourous air 78 is first passed through a film plastics capture step 82, the film plastics captured thereby optionally being passed to a film plastics recycling step 84 and/or to the oversize rejects stream 22. The odour management system 80, film plastics capture step 82 and film plastics recycling step 84 are further illustrated in FIG. 6.

The air extraction arrangement 76 comprise a series of panels (not shown) to enable containment of dust, odour and debris such that the air can be exchanged and air quality maintained by intercepting odours at their source.

Figure 3:
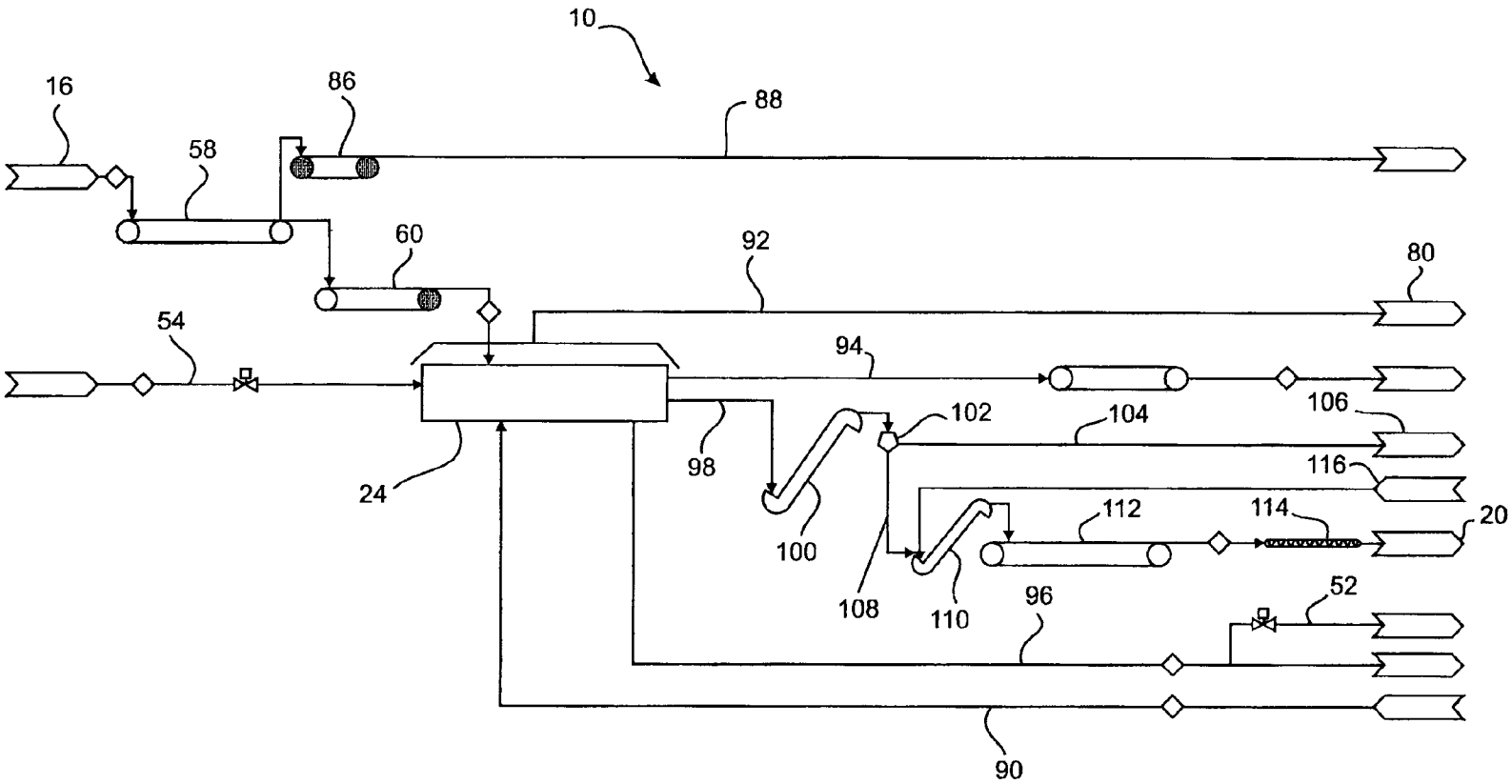
FIG. 3 is a diagrammatic representation of a glass and grit separation step to which a fine organic fraction is passed from the first size based separation step, showing also the separation of ferrous recyclables from that fine organic fraction.

In FIG. 3 there is shown the fine organic fraction 16 passing via conveyors 58 and 60 to the glass and grit separation step 24. The fine organic fraction 16 is passed through a magnetic separation step 86, producing a recyclable ferrous fraction stream 88, prior to passage to the glass and grit separation step 24.

The glass and grit separation step 24 is a two stage wet separation process. Process water 90 from digestion 20 is utilised, and the bore make-up water 54 is optionally utilised, in the glass and grit separation step 24. Odourous air 92 from the glass and grit separation step 24 is again passed to the odour management system 80. Outputs from the glass and grit separation step 24 include glass and grit 94, an organic rich water 96 and an organics stream 98. A portion of the organic rich water 96 may be directed to the trommel 44 as water 52.

The organics stream 98 is passed by drag chain conveyor 100 to chute 102 from which a first stream 104 of organics is directed to a separation step, for example a star screen 106, for separation of film plastics, and a second stream 108 of Washed organics is passed to a drag chain conveyor 110, a conveyor 112 and screw conveyor 114. Cleaned organics 116 from the star screen 106 are returned to the drag chain conveyor 110. The washed organics 108 with any returned cleaned organics 116 are passed to the digestion process 20. The Applicant's preferred mode of operation is such that the organics stream 98 is directed in full to either the star screen 106 or to the digestion process 20.

Figure 4:
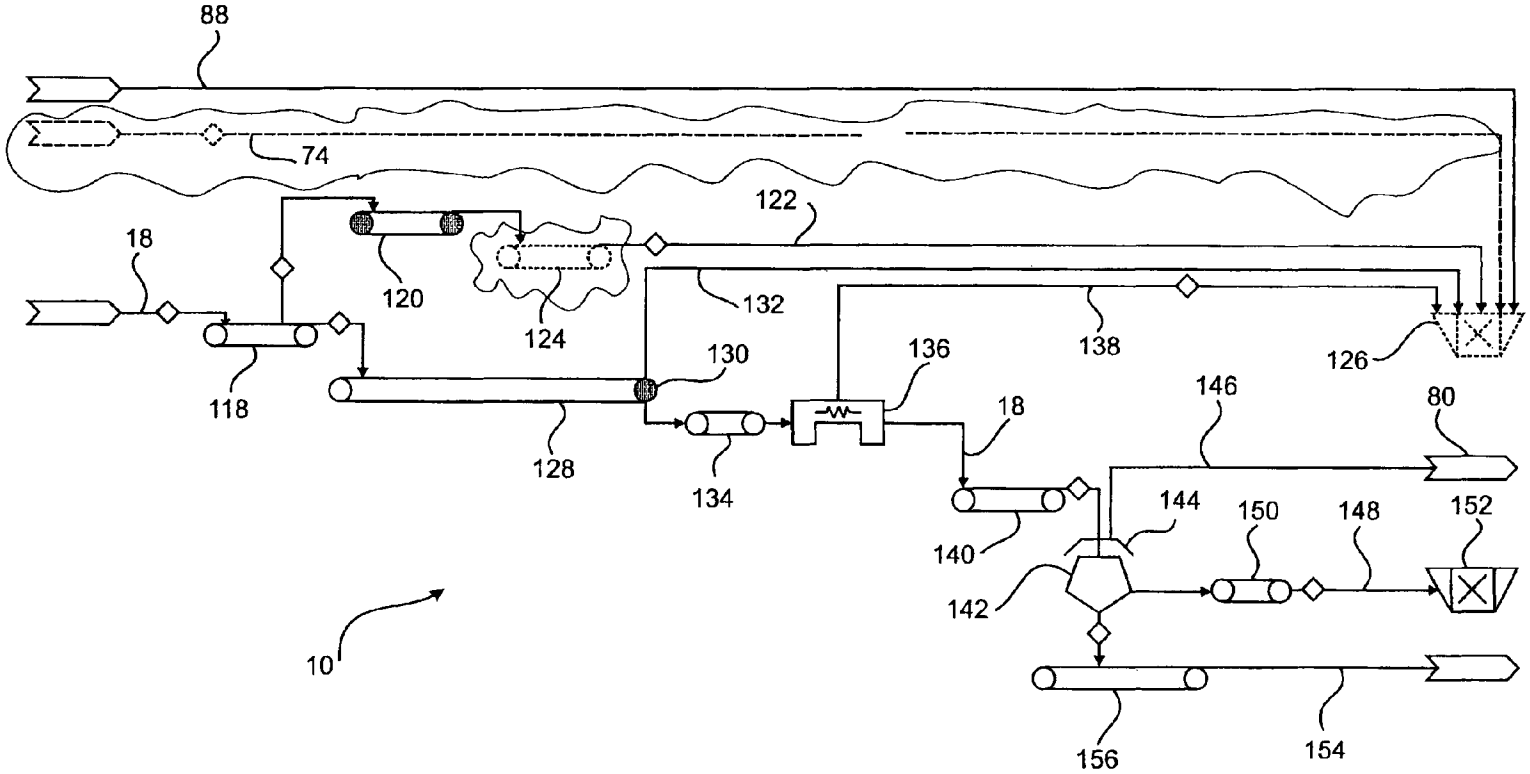
FIG. 4 is a diagrammatic representation of a series of ferrous and non-ferrous separation steps, including magnetic separation and eddy current separation steps, and a manual or automatic optical sorting step to remove hard plastics materials.

In FIG. 4 there is shown the coarse fraction 18 being passed from conveyor 62 (shown in FIG. 2) to a conveyor 118 from which the coarse fraction 18 is subjected to a magnetic separation step 120 producing a separated ferrous fraction 122 that is passed, by way of a conveyor 124, to a storage bin area 126. The ferrous fractions 74 and 88 are also passed to the storage bin area 126.

The coarse fraction 18 remaining after the magnetic separation step 120 is passed to a conveyor 128 equipped with a magnetic drum head 130. A ferrous product 132 from the magnetic drum head 130 is passed to the storage bin area 126 whilst the remainder of the coarse fraction 18 is directed to an eddy current separator feeder 134 and in turn to an eddy current separator 136. The separator 136 produces a non-ferrous product stream 138 which is again passed to the storage bin area 126. The remainder of the coarse fraction 18 passes by way of conveyor 140 to a manual sorting step 142. It is understood that the ferrous and non-ferrous metals will be stored separately in the storage bin area 126.

The manual sorting step 142 is equipped with odour extraction 144 that passes odourous air 146 again to the odour management system 80. The manual sorting step 142 is used to produce a mixed hard recyclable plastics product 148 comprising mainly High Density Poly Ethylene (HDPE), Low Density Poly Ethylene (LDPE), Poly Propylene (PP) and Poly Ethylene Terephthalate (PET) that is conveyed by conveyor 150 to a plastics baler 152. These plastics can be optionally sorted automatically using commercially available optical sorting technology, and can further optionally be, separated into their respective types where suitable markets exist for their recycling into useful products. The remaining coarse fraction, termed the final coarse fraction 154, is passed by conveyor 156 to a reversible conveyor 158, as can be seen in FIG. 5.

The reversible conveyor 158 can be used to recirculate the final coarse fraction 154 to the first size based separation step 14, as shown in FIG. 2, at the control of the operators of the method 10. Alternatively, the reversible conveyor 158 may pass the final coarse fraction 154 to conveyors 66 and 68 to the combined rejects stream 70 to prevent accumulation of recirculating coarse material 18 within the trommel 44 and on the conveyors and separators 62, 118, 128, 134, 136, 140, 142, 156 and 158. The combined rejects stream 70 is ultimately passed to storage or transport off-site.

The digestion process 20 produces a compost product 26 that is passed to the star screen 28 for removal of any remaining film plastics and in turn to temporary storage and transport off-site as the final compost product 30. The digestion process 20 further produces a biogas product 180, best seen in FIG. 7. The biogas product 180 is passed to a power generation facility 182 that provides for the clean up 184 of the biogas, producing water 186 as a by-product, and for electricity generation 188. Additionally, heat recovery 190 is facilitated.

The method 10 of the present invention incorporates a relatively rapid screening or separation step 14 and consequently minimises the level of biological processes occurring prior to passing of organics to the digestion step 20, thereby minimising the production of odours. Any odours that are present or produced are generally captured at source, as described above, and passed to the odour management system 80. Minimising the biological degradation of organic waste during the separation process facilitates enhanced energy conservation during digestion 20.

The method 10 of the present invention is able to operate in a substantially continuous basis.

The recirculation of the final coarse fraction 154 minimises the volume of the combined rejects stream 70 and enhances the efficiency of capture of fine organic material 16 that would otherwise have become rejects, relative to prior art processes.

It is envisaged that the method 10 of the present invention results in a combined rejects stream 70 that is between only about 15 to 30% of the MSW input, depending upon the composition thereof, and is comprised of materials of generally no commercial value, such as bulky oversize composite plastic items, larger pieces of textiles and wood, and biologically inert materials, for example.

Modifications and variations such as would be apparent to the skilled addressee are considered to fall within the scope of the present invention.

The invention claimed is:

1. A method for solid waste separation and processing comprising the method steps of:

(a) Passing a mixed municipal solid waste comprising both organic and inorganic materials to a first size based separation step, in which the waste is homogenised, producing at least a fine organic fraction and a coarse fraction;

(b) Passing the fine organic fraction to a digestion process by way of:

i. a metals separation step; and ii. a glass and grit separation step, (c) Recirculating the coarse fraction of step (a) through the first size based separation step at least once.

2. A method according to claim 1, wherein the metals separation step of step (b) includes a step in which ferrous metals are substantially removed.

3. A method according to claim 2, wherein the metals separation step is provided in a series of independent steps.

4. A method according to claim 1, wherein the glass and grit separation step removes a significant proportion of any glass and grit present in the fine organic fraction.

5. A method according to claim 1, wherein the glass and grit separation step is a wet separation step.

6. A method according to claim 5, wherein the glass and grit separation step is a two-stage wet separation step.

7. A method according to claim 1, wherein prior to the digestion process the fine organic fraction is passed to a separation step in which film plastics are substantially removed.

8. A method according to claim 1, wherein the first separation step of step (a) comprises passing the municipal solid waste to a trommel, from which the fine organic fraction and coarse fraction are produced.

9. A method according to claim 8, wherein a rejects fraction is also produced by the first separation step of step (a), comprising those materials that pass completely through to the end of the trommel.

10. A method according to claim 1, wherein the homogenisation of step (a) is achieved in part through the introduction of water.

11. A method according to claim 1, wherein the homogenisation captures paper and cardboard into the fine organic fraction.

12. A method according to claim 10, wherein water sprays are provided in a first portion of the trommel.

13. A method according to claim 1, wherein the coarse fraction produced in step (a) comprises product having a size between about 40 mm and 250 mm.

14. A method according to claim 13, wherein the coarse fraction produced in step (a) comprises product having a size between about 60 mm and 250 mm.

15. A method according to claim 1, wherein the rejects fraction produced in the first separation step of step (a) has a size of greater than about 250 mm.

16. A method according to claim 1, wherein the digestion process produces an intermediate compost product.

17. A method according to claim 16, wherein the intermediate compost product is passed to a separation step in which residual film plastics are separated from the compost product, and an oversized fraction removed, thereby producing a final compost product.

18. A method according to claim 1, wherein the coarse fraction is passed to a metals separation step in which ferrous and non-ferrous metals are substantially removed.

19. A method according to claim 18, wherein the metals separation step is provided in a series of independent steps.

20. A method according to claim 19, wherein the metals separation step comprises passing the coarse fraction to at least a single magnetic separator and an eddy current separator.

21. A method according to claim 18, wherein after the metals separation step the coarse fraction is passed to a sorting step by which plastics materials are separated.

22. A method according to claim 21, wherein the sorting step carried out by way of either manual means or mechanical means.

* * * * *